United States Patent [19]

Noorily

[11] Patent Number: 4,711,511

[45] Date of Patent: Dec. 8, 1987

[54] LATCHING APPARATUS FOR AN ELECTRICAL CONNECTOR

[75] Inventor: Peter Noorily, Bridgewater, N.J.

[73] Assignee: Thomas & Betts Corporation, Raritan, N.J.

[21] Appl. No.: 6,418

[22] Filed: Jan. 23, 1987

[51] Int. Cl.[4] ..... H01R 13/639

[52] U.S. Cl. ..... 439/347; 439/372

[58] Field of Search ..... 339/91 R, 47 R, 48, 339/49 R, 49 B

[56] References Cited

U.S. PATENT DOCUMENTS

| | | | |
|---|---|---|---|
| 2,566,993 | 9/1951 | Parsons | 173/328 |
| 2,891,103 | 6/1959 | Swengel | 174/153 |
| 3,146,051 | 8/1964 | Woofter et al. | 339/47 |
| 3,178,674 | 4/1965 | Scheller | 339/217 |
| 3,207,536 | 9/1965 | Lawrence | 285/308 |
| 3,522,963 | 8/1970 | Farnden | 292/83 |
| 3,523,269 | 8/1970 | Witek, Jr. et al. | 339/91 |
| 3,688,243 | 8/1972 | Yamada et al. | 339/49 |
| 3,706,954 | 12/1972 | Krafthefer | 339/17 |
| 3,713,076 | 1/1973 | Gabrielian et al. | 339/91 R |
| 3,885,851 | 5/1975 | Bennett | 339/91 R |
| 4,010,998 | 3/1977 | Tolnar, Jr. et al. | 339/91 |
| 4,078,849 | 3/1978 | Fischer | 339/91 |
| 4,245,879 | 1/1981 | Buck | 339/128 |
| 4,370,013 | 1/1983 | Niitsu et al. | 339/82 |
| 4,448,467 | 5/1984 | Weidler | 339/17 |
| 4,449,767 | 5/1984 | Weidler | 339/17 |
| 4,449,778 | 5/1984 | Lane | 339/143 |
| 4,501,459 | 2/1985 | Chandler et al. | 339/48 |
| 4,508,415 | 4/1985 | Bunnell | 339/143 |
| 4,541,036 | 9/1985 | Landries et al. | 361/426 |
| 4,548,455 | 10/1985 | Ezure | 339/91 R |
| 4,619,494 | 10/1986 | Noorily et al. | 339/103 M |
| 4,634,204 | 1/1987 | Detter et al. | 339/91 R |

FOREIGN PATENT DOCUMENTS

| | | | |
|---|---|---|---|
| 0026703 | 4/1981 | European Pat. Off. . | |
| 0112713 | 7/1984 | European Pat. Off. . | |
| 2408232 | 6/1979 | France | 339/91 R |

OTHER PUBLICATIONS

Publication (author unknown) No. GA27-3579-1, 5 pages, date unknown.

Research Disclosure, Jan. 1981, FIGS. 1-4.

*Primary Examiner*—John McQuade

*Attorney, Agent, or Firm*—Robert M. Rodrick; Salvatore J. Abbruzzese

[57] ABSTRACT

A latching apparatus is provided for an electrical connector of the type having a housing including a plurality of electrical contacts therein. The latching apparatus comprises a deflectable arm that is pivotally supported on the connector housing, the pivot being disposed generally between the two ends of the pivotal arm such that both opposed ends of such arm may move relatively toward and away from the connector housing. The front end of the deflectable arm is provided with a latch for attachment to a complementary latch of a mateable electrical connector or the like. A slidable locking bar is captively supported on the housing for movement between a first position and a second position. The locking bar and deflectable arm include cooperative locking means disposed on both sides of the pivot that are operative in the first position to prevent movement of both ends of the latching arm and in the second position to permit free movement of both arm ends. As such, when the bar is in the first position, secured locking engagement of the latch is provided when attached to the mateable connector, while when the locking bar is in the second position, the free movement of the deflectable arm permits ease of attachment to or detachment from the mateable connector.

15 Claims, 5 Drawing Figures

LATCHING APPARATUS FOR AN ELECTRICAL CONNECTOR

FIELD OF THE INVENTION

The present invention relates to an improved latching apparatus for an electrical connector that is particularly useful in the data communications industry.

BACKGROUND OF THE INVENTION

In the use of electrical connectors there is need to provide secured mechanical and electrical engagement between the electrical connector and a mateable electrical connector or other electrical device or equipment. Various latching techniques have been devised for use with electrical connectors in an effort to provide such secured engagement. One of the concerns in providing this secured engagement is the ease with which the connectors may be both attached to and detached from other devices. To satisfy this concern, connectors having latching mechanisms comprising pivotally supported latching arms that facilitate both ease of attachment and detachment have been developed. For example, latching structures of this type are shown in U.S. Pat. No. 4,449,778 (issued on May 22, 1984) and U.S. Pat. No. 4,501,459 (issued on Feb. 26, 1985), both of these connectors being of the electrically shielded type for particular use in the data communications industry. While the pivotal latching arms, as shown in these patents, assist in the ease of attachment and detachment, there is no positive locking structure that maintains the connector in secured relation once connected to another connector or other electrical component. In an effort to compensate for this problem, a separate, external wedge is provided for subsequent attachment to the electrical connector in a manner to prevent the latching mechanism from separating in use.

In another known shielded electrical connector a latching structure is provided to not only facilitate the ease of attachment and detachment but also to provide a locking device while the connector is in use. In U.S. Pat. No. 4,619,494 (issued on Oct. 28, 1986) and assigned to the same Assignee as is the subject application, the latching mechanism includes a slidable actuator that moves a pivotal latching arm in a manner to control both attachment and detachment as well as to serve as a lock to provide secure engagement while the connector is in use. While it is advantageous to maintain some of the features of the known connectors and their latching mechanisms, it is also desirable to provide improvements thereto, considering both cost and ease of use.

SUMMARY OF THE INVENTION

It is an object of the present invention to provide an improved latching apparatus in an electrical connector.

In accordance with a preferred form of the invention, an improved latching apparatus is provided in an electrical connector of the type having a housing and a plurality of electrical contacts therein. The latching apparatus comprises an elongate member deflectably supported by a pivot on the housing, the pivot being located generally intermediate such elongate member. As a result of such pivotal support, both longitudinal ends of the elongate member may move generally transversely toward and away from the housing. One end of the elongate member includes a latch for latching to a latch of another mateable connecting device. The latching apparatus further includes a movable locking bar captively supported on the housing for slidable movement thereon between a first position and a second position. The locking bar and the elongate member include cooperative locking means disposed on both sides of the pivot, operative when the locking bar is in the first position to prevent transverse movement of both ends of the member and non-operative when the locking bar is in the second position, thereby permitting transverse movement of both ends of the elongate member.

BRIEF DESCRIPTION OF THE DRAWINGS

FIG. 4(*b*) is a side elevation view, as in FIG. 4A, wherein the locking bar is in the second position and wherein the latching arm is pivoted such that the latch at the mating end is in a downward position.

DETAILED DESCRIPTION OF THE PREFERRED EMBODIMENT

Figure 1:
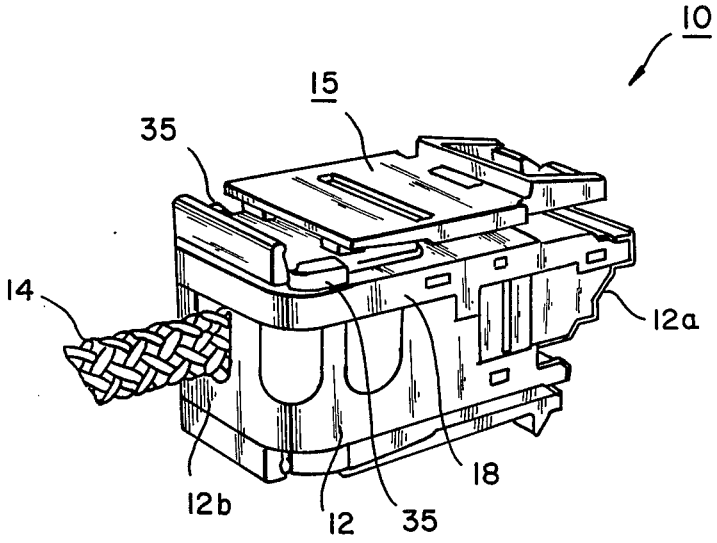
FIG. 1 is a side perspective view of a shielded electrical connector embodying the improved latching apparatus of the subject invention.

Referring now to the drawings, there is shown in FIG. 1 an electrical connector 10 of the shielded type as more particularly shown and described in commonly owned U.S. Pat. No. 4,619,494 as referred to hereinabove. Briefly, connector 10 comprises an insulative housing 12, a front end 12*a* of which defines a mating end of the connector and a rear end 12*b* of which is adapted to receive a shielded electrical cable 14 for internal connection to a plurality of electrical contacts (not shown) supported interiorly of the housing 12. Latching apparatus 15, as will be described in more detail hereinbelow, is incorporated in electrical connector 10. It should be appreciated, however, that the latching apparatus of the subject invention, while particularly useful in the type of electrical connector as shown herein, is not so limited and may be used with other electrical connectors.

Figure 2:
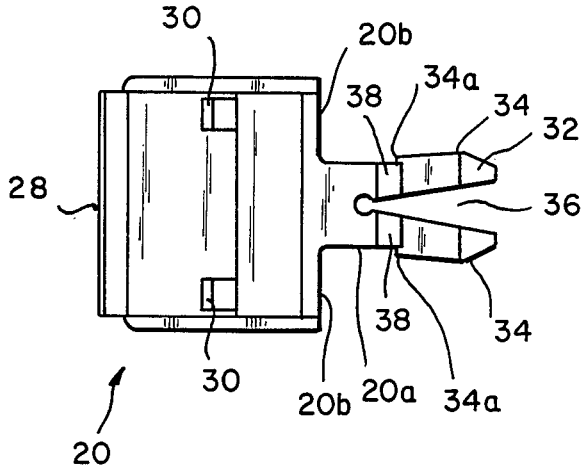
FIG. 2 is a top plan view of the slidable locking bar of the subject latching apparatus.
Figure 3:
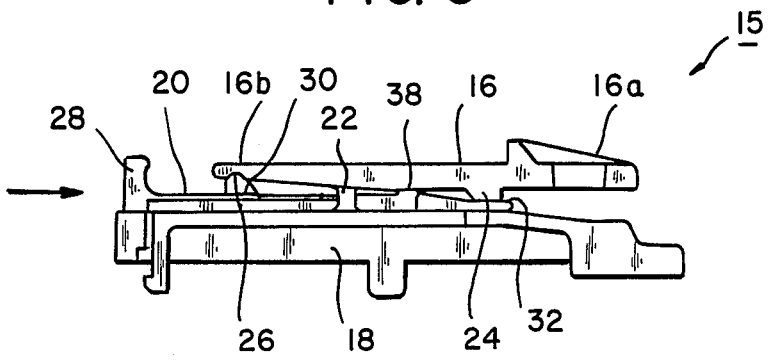
FIG. 3 is a side elevation view of a portion of the housing of the electrical connector of FIG. 1 showing the latching apparatus with the locking bar disposed in a first position wherein the latching arm is in a locked condition.
Figure 4:
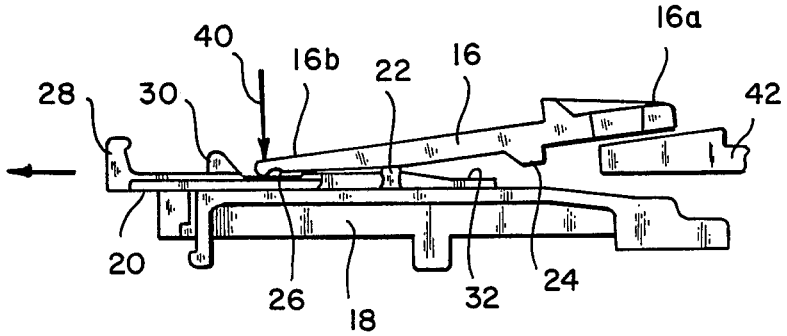
FIG. 4(*a*) is a side elevation view, as in FIG. 3, now showing the locking bar in a second position wherein the latching arm is free to pivot, the latch at the mating end being shown in an upward position.
Figure 4B:
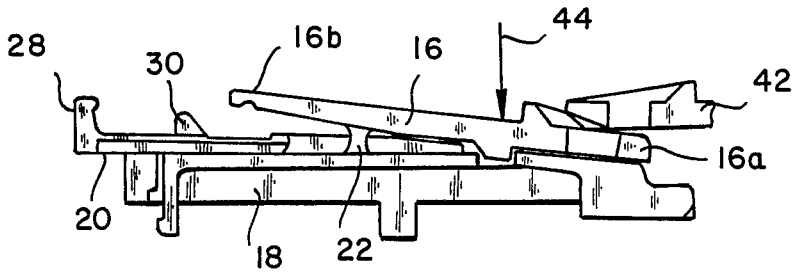

Turning now also to FIG. 2, FIG. 3 and FIGS. 4(*a*) and (*b*), the details of the latching apparatus may be more fully understood. Latching apparatus 15 comprises a relatively rigid, deflectable latching arm 16 that is pivotally mounted on the housing cover 18 and a slidable locking bar 20. Housing cover 18 is a portion of the housing and is preferably separable from the remainder of the electrical housing 12 in a manner to facilitate the termination of the electrical cable 14 to the connector contacts supported in the housing. The deflectable arm 16 is attached to the cover 18 by a flexible web 22 such that the arm 16 is upwardly spaced from and pivotally movable on the cover 18. The deflectable arm 16 is generally elongate, the arm 16 being supported on the cover 18 intermediate its front end 16*a* and its rear end 16*b*. As such, both the front end 16*a* and the rear end 16*b* of the flexible latching arm are movable generally transversely toward and away from the cover 18 of the electrical connector housing. The front end 16*a* of the arm is particularly configured to provide a latch thereat for mechanical engagement with a complementary latch of another electrical connector or other electrical device. Adjacent the front end 16*a* of the deflectable arm and disposed on its lower surface is a downwardly projecting member defining a locking spacer 24. At the opposite end 16*b* of the arm, a generally curved recess 26 is formed in the lower surface of the arm 16. The function and purpose of the arm locking spacer 24 and the recess 26 will be described hereinafter.

The slidable locking bar 20 is relatively rigid and is of generally planar construction. At the rear end of the locking bar there is provided an upwardly extending handle 28 adapted for manual grasping and operation of the latching apparatus by the user. Upwardly extending from the upper surface of the locking bar 20 is a projection defining a bar locking spacer 30, locking spacer 30 being adapted and configured for engagement with the deflectable arm 16. The front end of the locking bar comprises a downwardly tapering surface 32 adapted for engagement with the locking spacer 24 of the deflectable arm 16.

As shown particularly in FIG. 2, the locking bar 20 includes at its front end 20*a* a pair of spaced tines 34 defining a slot 36 therebetween, tines 34 being resiliently laterally deflectable toward and away from each other. In the preferred form, the bar locking spacer 30 is of two-part construction with a space therebetween. Locking bar 20 further includes adjacent its front end 20*a* a generally curved upwardly extending protrusion 38 disposed on either side of the slot 36.

The sliding bar 20 is captively supported for sliding, longitudinal movement between the deflectable arm 16 and the housing cover 18. In the preferred configuration the flexible web 22 is of two-part construction with an opening (not shown) therebetween. The resiliently deflectable tines are inserted through the opening between the two-parts of the web 22, laterally deflecting the tines until shoulders 34*a* of each tine pass through the web opening. Shoulders 34*a* and rear surfaces 20*b* serve to captivate the sliding bar about the web 22. Longitudinal sliding of the locking bar 20 is controlled by guide blocks 35 (see FIG. 1) disposed on the cover 18 and which engage the side, marginal edges of the locking bar during movement.

Referring now to FIGS. 3 and 4(*a*) and 4(*b*), the operation of the latching apparatus is more fully described. In FIG. 3, the locking bar 20 has been moved, by use of the handle 28, longitudinally to a first position which defines a locking position of the latching arm 16. In this position, the front surface 32 of the sliding bar 20 is in engagement with the downwardly projecting arm locking spacer 24 and the bar locking spacer 30 is engaged in the recess 26 of the deflectable arm 16. As the engagement of the respective locking spacers 24 and 30 is provided on both sides of the pivot 22 supporting the defectable arm 16, transverse movement of both ends 16*a* and 16*b* of the arm 16 is effectively prevented. As such, in connector use, the latch provided at the front end 16*a* of the arm is maintained in a positive locking position thereby preventing inadvertent disconnection during use which could occur due to vibrations and the like. The locked position is releasably held by a detent that is provided by the resilient receipt of the top of the bar locking spacer 30 in the arm recess 26. This detent is overcome by manually pulling the locking bar 20, leftwardly in the drawing figures.

Turning now to FIGS. 4(*a*) and 4(*b*), the facilitation of attachment to and detachment from other connectors or electrical components is shown. In FIG. 4(*a*) the locking bar 20 has been slid longitudinally rearwardly to its second position. In this position, bar locking spacer 30 has been pulled out from the recess 26 of the deflectable arm 16 and the bar front engagement surface 32 has been separated from the arm locking spacer 24. As such, both the front end 16*a* and rear end 16*b* of the deflectable arm 16 are free to move transversely toward and away from the cover 18. In this second position, the protrusion 38 on the locking bar 20 is disposed at a location coincident with the pivot 22. As such, the protrusion 38 will contact the undersurface of the arm in a manner to minimize any loose movement of the locking bar 20 that could result in this position inasmuch as the locking bar is held only at the rear of the connector by the guide blocks 35.

In FIG. 4(*a*), for example, as a result of a downward force on the rear end 16*b*, as represented by arrow 40, the front end 16*a* is pivoted upwardly away from the cover 18. In use, the latch at the front end 16*a* of the arm is thereby permitted to be attached to or detached from another latch, generally shown by reference numeral 42, from this upward position. On the other hand, as shown in FIG. 4(*b*), when the locking bar 20 is in the second position, the front end 16*a* of the latch arm 16 may also be deflected downwardly by a force as represented by arrow 44. As such, the latch at the front end 16*a* of the arm may be resiliently snapped into a locking position with the latch 42 of another connector.

Having described the preferred embodiment of the latching apparatus of the subject invention, the advantages thereof should be now appreciated. The subject latching apparatus not only provides for ease of either attaching or detaching an electrical connector to or from a mateable component, but also provides a secured locking arrangement when the connector is attached to another connector or the like. It should be further appreciated that various modifications may be made to the subject latching apparatus without departing from the contemplated scope of the invention. Accordingly, the preferred embodiment described herein is intended in an illustrative rather than a limiting sense. The true scope of the invention is set forth in the claims appended hereto.

I claim:

1. In an electrical connector of the type having a housing and a plurality of electrical contacts therein, latching apparatus comprising:

an elongate member deflectably supported by a pivot on said housing, said pivot being located generally intermediate said elongate member such that both longitudinal ends of said member may move generally transversely toward and away from said housing, one end of said member including a latch for latching to a latch of another mateable connecting device, and a movable locking bar captively supported on said housing for slidable movement thereon between a first position and a second position, said locking bar and said member including cooperative locking means disposed on both sides of said pivot operative when said locking bar is in said first position to prevent transverse movement of both ends of said member and non-operative when said locking bar is in said second position, thereby permitting transverse movement of both ends of said member.

2. The invention according to claim 1, wherein said pivot comprises a flexible web.

3. The invention according to claim 1, wherein said locking bar is substantially planar and is slidably captivated between said housing and said member for sliding movement in the longitudinal direction.

4. The invention according to claim 3, wherein said cooperative locking means includes a locking spacer on said member and on said locking bar.

5. The invention according to claim 4, wherein locking spacer on said locking bar projects in a direction toward said member and away from said housing and the locking spacer on said member projects in a direction toward said locking bar and said housing.

6. The invention according to claim 5, wherein said member locking spacer is located adjacent said latch and wherein said bar locking spacer is located adjacent the opposing end of said member.

7. The invention according to claim 6, wherein said member has at its end opposite said latch a detent recess for detachable engagement with said bar locking spacer.

8. In an electrical connector of the type having a housing including a plurality of electrical contacts, said housing having a mating end for connection to another electrical connector, latching apparatus comprising:

an arm pivotally supported on said housing, said arm having two opposed ends, one end of which includes a latch adjacent the mating end of said connector, a pivot being disposed between said two ends of said arm to thereby permit movement of both of said ends toward and away from said housing; and a slidable locking bar, captively supported on said housing for movement between a first position and a second position, said bar including a locking spacer disposed adjacent one end of said arm and said arm including a locking spacer disposed adjacent the opposite end of said arm, said bar locking spacer being engageable with said arm and said arm locking spacer being engageable with said bar when said bar is in said first position to thereby prevent movement of both of said arm ends relative to said housing, said bar locking spacer being in non-engaged relation with said arm and said arm locking spacer being in non-engaged relation with said bar when said bar is in said second position to thereby permit movement of both ends of said arm relative to said housing.

9. The invention according to claim 8, wherein said arm is pivotally supported on said housing by a flexible web providing a space between said arm and said housing.

10. The invention according to claim 9, wherein said bar is slidably captivated in said space.

11. The invention according to claim 9, wherein said arm locking spacer is located adjacent said latch and said bar locking spacer is located adjacent the opposite end of said arm.

12. The invention according to claim 11, wherein said arm locking spacer projects outwardly from said arm toward said locking bar and wherein said bar locking spacer projects outwardly from said bar toward said arm.

13. The invention according to claim 12, further comprising detent means on said arm and locking bar for releasably holding said locking bar in said first position.

14. The invention according to claim 13, wherein said detent means comprises said bar locking spacer and a recess formed in said arm at the end opposite said latch for resilient receipt therein of a portion of said bar locking spacer.

15. The invention according to claim 8, wherein said locking bar further includes thereon an upwardly projecting protrusion disposed on said bar to coincide with the location of said pivot when said locking bar is in said second position, said protrusion being adapted to contact said arm thereat in a manner to minimize loose movement of said locking bar.

* * * * *